US008608332B1

(12) United States Patent
Minniti

(10) Patent No.: US 8,608,332 B1
(45) Date of Patent: Dec. 17, 2013

(54) FAN BRELLA

(76) Inventor: Sergio Minniti, Darien, IL (US)

( * ) Notice: Subject to any disclaimer, the term of this patent is extended or adjusted under 35 U.S.C. 154(b) by 0 days.

(21) Appl. No.: 13/495,193

(22) Filed: Jun. 13, 2012

(51) Int. Cl.
*A45B 3/04* (2006.01)

(52) U.S. Cl.
USPC ..... 362/102; 362/457

(58) Field of Classification Search
USPC ..... 362/249.01–249.02, 249.11, 227, 86
See application file for complete search history.

(56) References Cited

U.S. PATENT DOCUMENTS 5,349,975 A 9/1994 Valdner
D409,369 S 5/1999 Vega
6,298,866 B1 10/2001 Molnar, IV
6,612,713 B1 9/2003 Kuelbs
6,691,721 B2 2/2004 Apple
7,322,208 B1 1/2008 Griffin
7,497,583 B2 * 3/2009 Ma ..... 362/102
D591,842 S 5/2009 Young
7,695,153 B2 * 4/2010 Tsai ..... 362/102
D669,976 S * 10/2012 Hsu ..... D23/382
2005/0172987 A1 8/2005 Byrnes
2007/0242450 A1 10/2007 Blatecky
2008/0092936 A1 4/2008 Carabillo
2009/0014041 A1 * 1/2009 Li ..... 135/16

* cited by examiner

*Primary Examiner* — Diane Lee
*Assistant Examiner* — Gerald J Sufleta, II

(57) ABSTRACT

A multi-function umbrella attachment assembly for cooling, lighting, and providing music to an area adjacent to an umbrella. The assembly includes a panel and an aperture extending through the panel. The aperture is configured for positioning around a pole of an umbrella. At least one light emitter is coupled to the panel. At least on speaker is coupled to the panel. At least one fan is coupled to the panel.

11 Claims, 5 Drawing Sheets

FAN BRELLA

BACKGROUND OF THE DISCLOSURE

Field of the Disclosure

The disclosure relates to umbrella attachment devices and more particularly pertains to a new umbrella attachment device for cooling, lighting, and providing music to an area adjacent to an umbrella.

SUMMARY OF THE DISCLOSURE

An embodiment of the disclosure meets the needs presented above by generally comprising a panel and an aperture extending through the panel. The aperture is configured for positioning around a pole of an umbrella. At least one light emitter is coupled to the panel. At least on speaker is coupled to the panel. At least one fan is coupled to the panel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
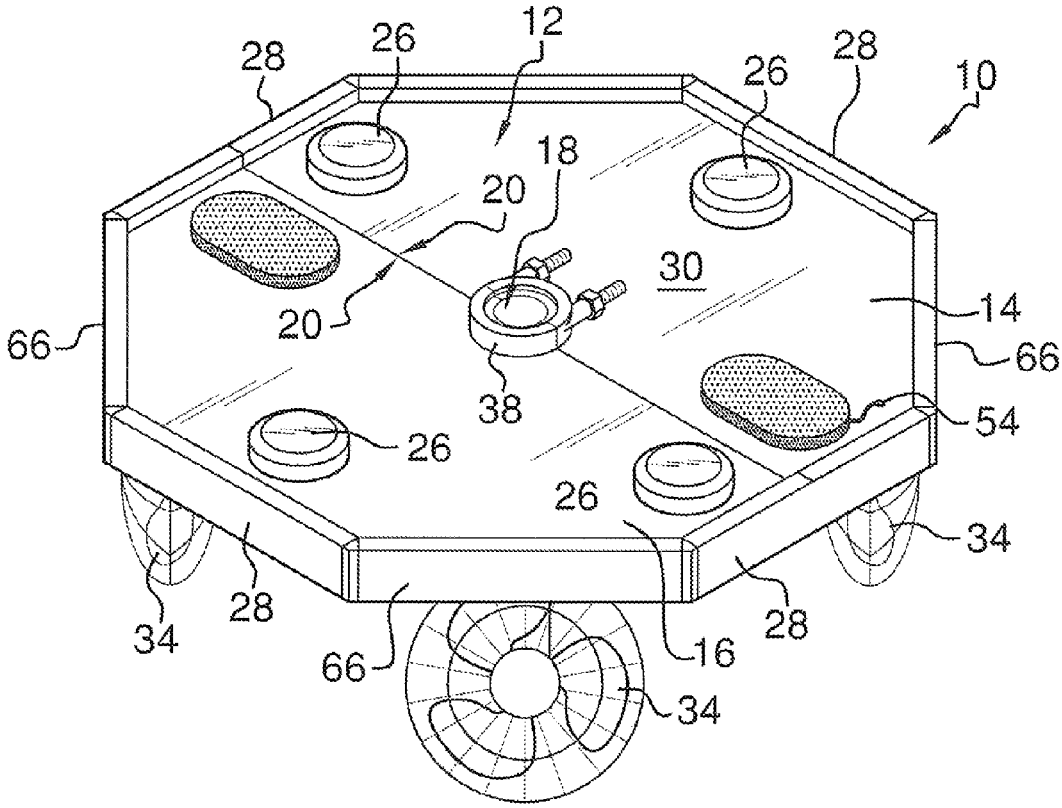
FIG. 1 is a bottom front side perspective view of a multi-function umbrella attachment assembly according to an embodiment of the disclosure.
Figure 2:
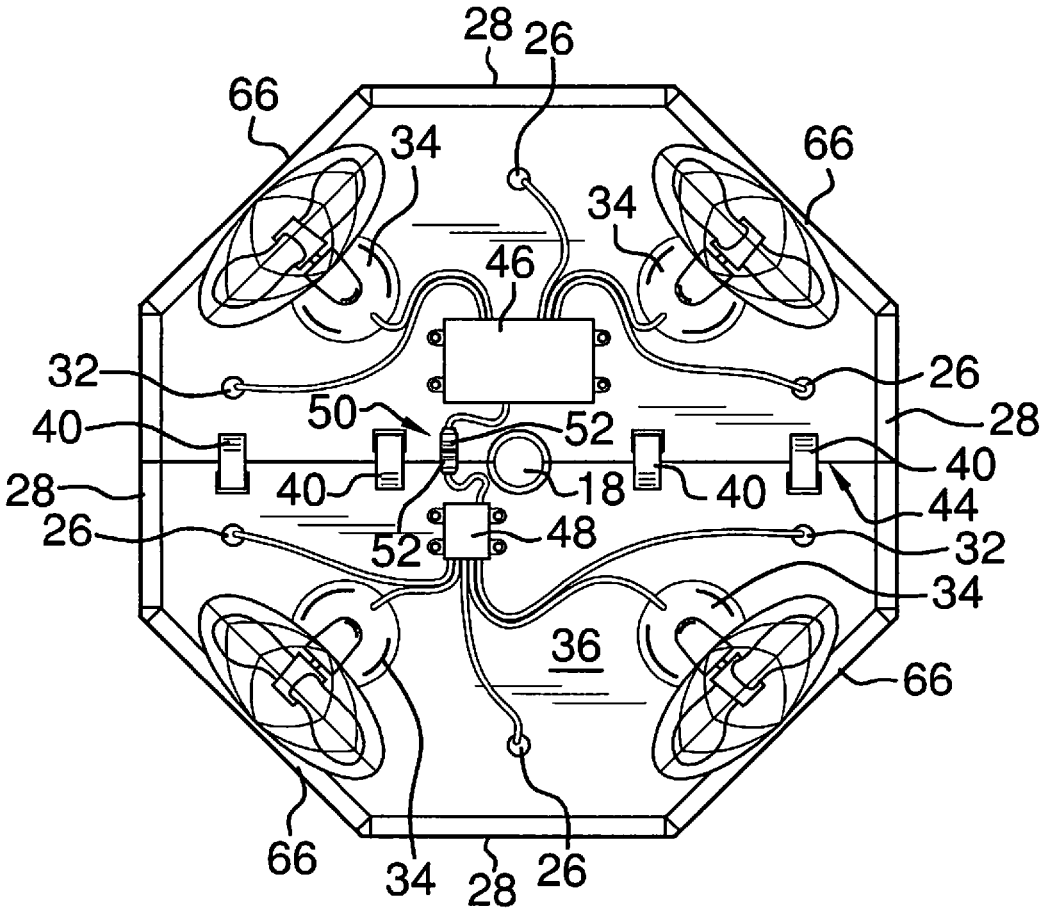
FIG. 2 is a top view of an embodiment of the disclosure.
Figure 3:
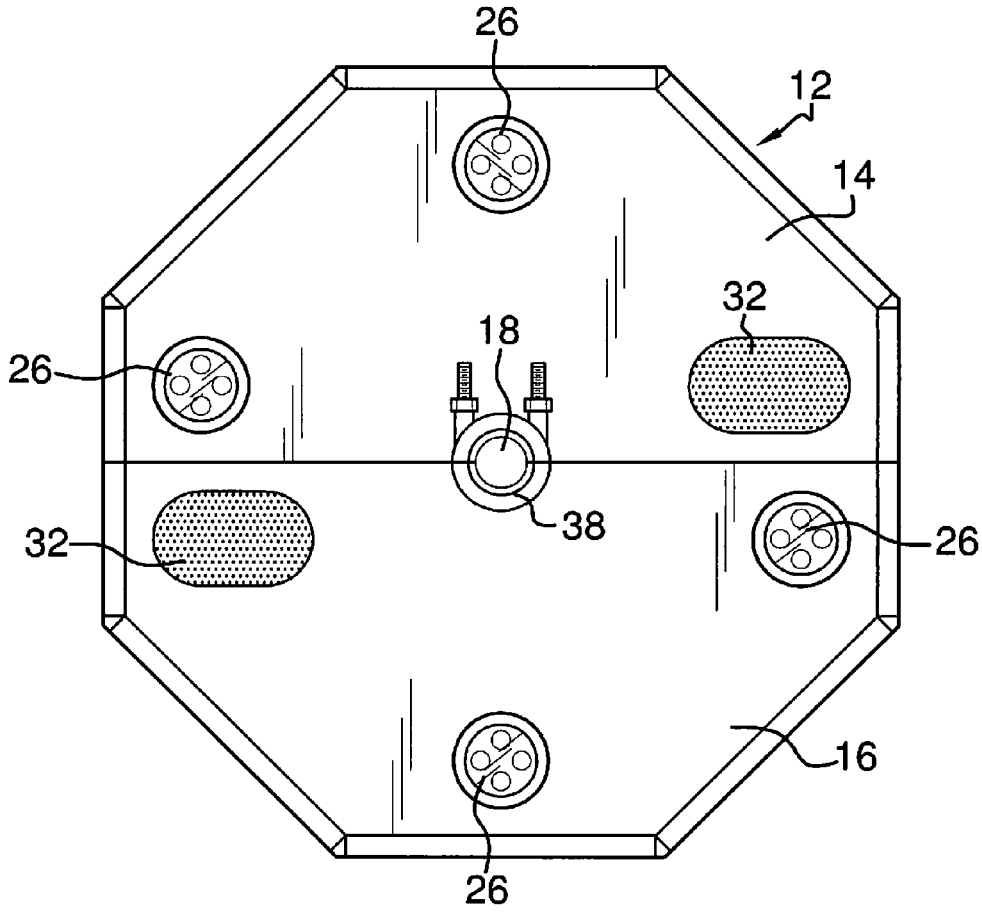
FIG. 3 is a bottom view of an embodiment of the disclosure.
Figure 4:
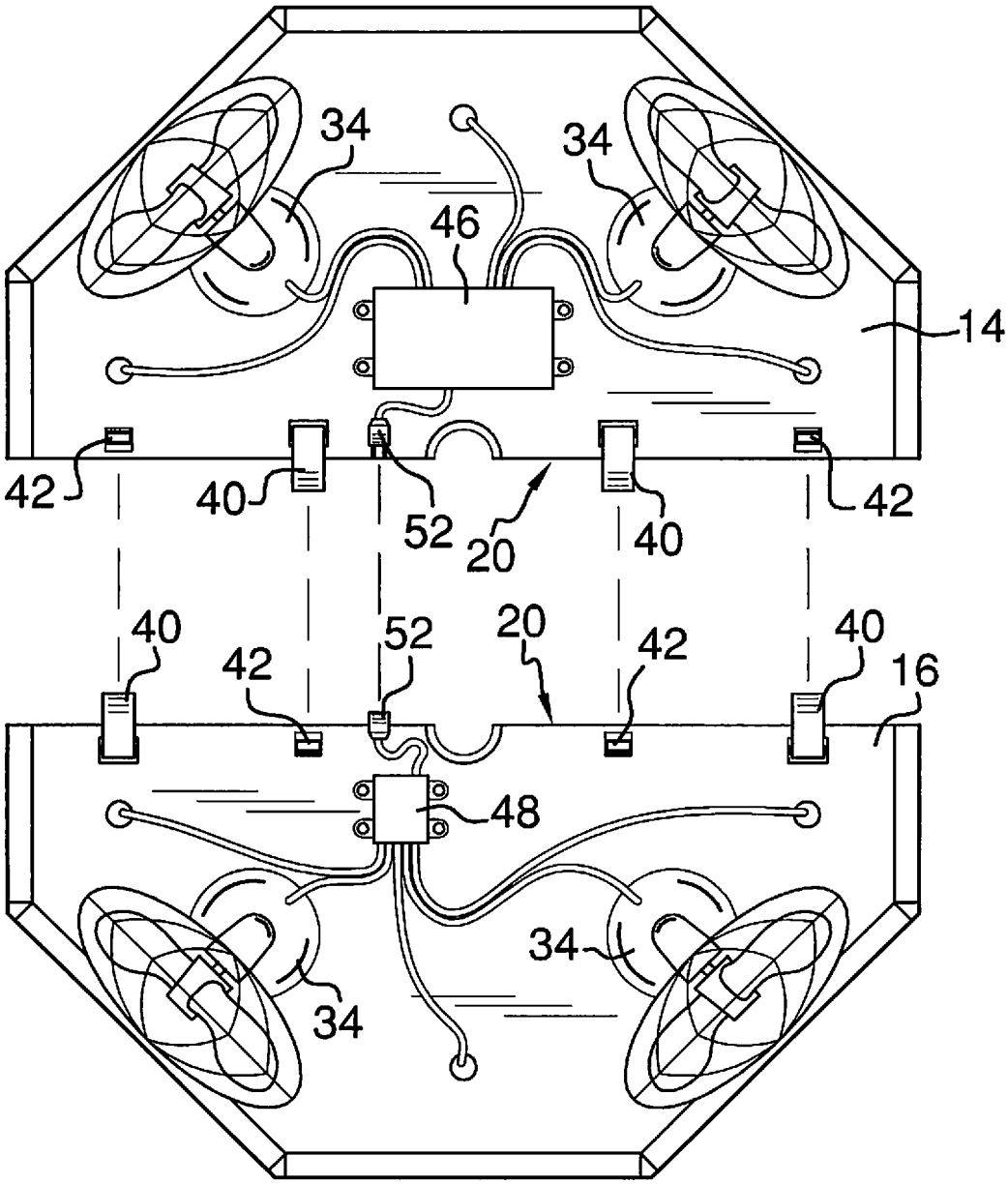
FIG. 4 is a partially exploded top view of an embodiment of the disclosure.
Figure 5:
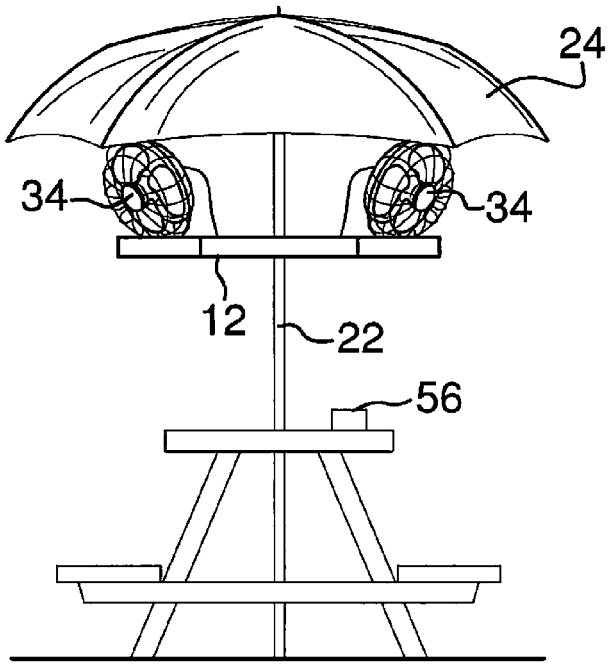
FIG. 5 is a side view of an embodiment of the disclosure in use.
Figure 6:
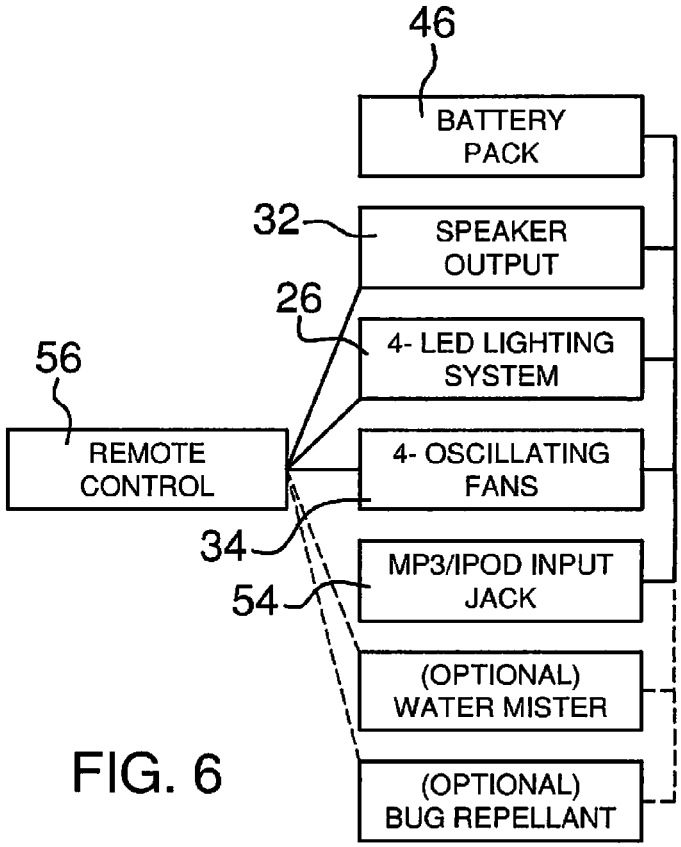
FIG. 6 is a schematic view of an embodiment of the disclosure.

With reference now to the drawings, and in particular to FIGS. 1 through 6 thereof, a new umbrella attachment device embodying the principles and concepts of an embodiment of the disclosure and generally designated by the reference numeral 10 will be described.

As best illustrated in FIGS. 1 through 6, the multi-function umbrella attachment assembly 10 generally comprises an octagonal panel 12. The panel may have a first section 14 and a second section 16. The first section 14 and the second section 16 may be mirror images of each other. The first section 14 is selectively separable from the second section 16. An aperture 18 extends through the panel 12. The aperture 18 is positioned between adjoining edges 20 of the first section 14 and second section 16. The aperture 18 is configured for positioning around a pole 22 of an umbrella 24.

At least one light emitter 26 is coupled to the panel 12. A plurality of light emitters 26 may be provided. Each light emitter 26 may be positioned proximate an associated side 28 of the panel 12 on a bottom surface 30 of the panel 12. Thus, the light emitters 26 are directed downwardly from the panel 12 when the panel 12 is coupled to the pole 22. At least one speaker 32 or a plurality of speakers 32 is coupled to the panel 12. Each speaker 32 is coupled to an associated one of the first section 14 and the second section 16 such that the speakers 32 are positioned in mirror image relative to the pole 22 when the panel 12 is coupled to the pole 22. The speakers 32 may be coupled to and directed downwardly from the bottom surface 30 of the panel 12. At least one or a plurality of fans 34 is coupled to the panel 12. Each fan 34 is positioned proximate an associated side 66 of the panel 12. The fans 34 are positioned on a top surface 36 of the panel 12.

A pole clamp 38 is coupled to the panel 12. The pole clamp 38 surrounds the aperture 18 and is configured for frictionally engaging the pole 22 of the umbrella 24. A plurality of panel clamps 40 are also coupled to the panel 12. A plurality of slots 42 are positioned in the top surface 36 of the panel 12 proximate a junction 44 between the first section 14 and the second section 16. The panel clamps 40 extend across the junction 44 and engage an associated one of the slots 42 whereby the first section 14 is coupled to the second section 16. The panel clamps 40 and slots 42 may alternate in positioning along the adjoining edges 20 of the first section 14 and the second section 16.

A power source 46 is coupled to the first section 14 of the panel 12. The power source 46 is electrically coupled to each fan 34 and each light emitter 26 coupled to the first section 14 of the panel 12. A wiring harness 48 may be coupled to the second section 16 of the panel 12. The wiring harness 48 is electrically coupled to each fan 34 and each light emitter 26 coupled to the second section 16 of the panel 12. A wiring connector 50 may be provided having separable sections 52. The wiring connector 50 is electrically coupled between the power source 46 and the wiring harness 48 to facilitate electrically coupling and uncoupling the fans 34 and light emitters 26 when separating the first section 14 and the second section 16. An input jack 54 may also be coupled to the panel 12. The input jack 54 is operationally coupled to each speaker 32. The input jack 54 may also be coupled to one of the speakers 32 through the wiring harness 48 and wiring connector 50 to facilitate separation of the first section 14 from the second section 16.

In use, panel 12 is coupled to the pole 22 under the umbrella 24. The fans 34, speakers 32, and light emitters 26 may each be selectively activated as desired to enhance the atmosphere adjacent to the umbrella as desired. A remote control 56 may be operationally coupled to the power source 46 through a wireless receiver and a processor selectively powering each of the components.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A multi-functional umbrella attachment assembly comprising:

a panel, said panel having a first section and a second section, said first section being selectively separable from said second section;

an aperture extending through said panel, said aperture being configured for positioning around a pole of an umbrella;

at least one light emitter being coupled to said first section of said panel and at least one light emitter being coupled to said second section of said panel;

at least one speaker being coupled to said panel;

at least one fan being coupled to said first section of said panel and at least one fan being coupled to said second section of said panel;

a power source coupled to said first section of said panel, said power source being electrically coupled to each said fan and each said light emitter coupled to said first section of said panel;

a wiring harness coupled to said second section of said panel, said wiring harness being electrically coupled to each said fan and each said light emitter coupled to said second section of said panel; and a wiring connector having separable sections, said wiring connector selectively coupling said first section and said second section, said wiring connector being electrically coupled between said power source and said wiring harness to facilitate coupling and uncoupling said fans and light emitters when separating said first section and said second section.

2. The assembly of claim 1, further including said panel being octagonal.

3. The assembly of claim 1, further including four said fans, each said fan being positioned proximate an associated side of said panel.

4. The assembly of claim 1, further including four said light emitters, each said light emitter being positioned proximate an associated side of said panel.

5. The assembly of claim 1, further including said first section and said second section being mirror images of each other.

6. The assembly of claim 1, further including said aperture being positioned between adjoining edges of said first and second sections.

7. The assembly of claim 1, further including a pole clamp coupled to said panel, said pole clamp being configured for frictionally engaging the pole of the umbrella.

8. The assembly of claim 1, further comprising:

a plurality of panel clamps coupled to said panel; and a plurality of slots positioned in said panel proximate a junction between said first section and said second section, said clamps extending across said junction and engaging an associated one of said slots whereby said first section is coupled to said second section.

9. The assembly of claim 1, further including two said speakers, each speaker being coupled to an associated one of said first section and said second section.

10. The assembly of claim 1, further including an input jack coupled to said panel, said input jack being operationally coupled to each said speaker.

11. A multi-functional umbrella attachment assembly comprising:

an octagonal panel, said panel having a first section and a second section, said first section and said second section being mirror images of each other, said first section being selectively separable from said second section;

an aperture extending through said panel, said aperture being positioned between adjoining edges of said first and second sections, said aperture being configured for positioning around a pole of an umbrella;

a plurality of light emitters being coupled to said panel, each said light emitter being positioned proximate an associated side of said panel;

a plurality of speakers being coupled to said panel, each said speaker being coupled to an associated one of said first section and said second section, a plurality of fans being coupled to said panel, each said fan being positioned proximate an associated side of said panel;

a pole clamp coupled to said panel, said pole clamp being configured for frictionally engaging the pole of the umbrella;

a plurality of panel clamps coupled to said panel;

a plurality of slots positioned in said panel proximate a junction between said first section and said second section, said clamps extending across said junction and engaging an associated one of said slots whereby said first section is coupled to said second section;

a power source coupled to said first section of said panel, said power source being electrically coupled to each said fan and each said light emitter coupled to said first section of said panel;

a wiring harness coupled to said second section of said panel, said wiring harness being electrically coupled to each said fan and each said light emitter coupled to said second section of said panel;

a wiring connector having separable sections, said wiring connector selectively coupling said first section and said second section, said wiring connector being electrically coupled between said power source and said wiring harness to facilitate coupling and uncoupling said fans and light emitters when separating said first section and said second section; and an input jack coupled to said panel, said input jack being operationally coupled to each said speaker.

* * * * *